US011848507B2

(12) United States Patent
Liu et al.

(10) Patent No.: US 11,848,507 B2
(45) Date of Patent: Dec. 19, 2023

(54) RADIATING ELEMENT, ANTENNA ARRAY, AND NETWORK DEVICE

(71) Applicant: HUAWEI TECHNOLOGIES CO., LTD., Guangdong (CN)

(72) Inventors: Xianglong Liu, Shenzhen (CN); Guanxi Zhang, Shanghai (CN); Long Shen, Shanghai (CN); Tuanjie Xue, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 79 days.

(21) Appl. No.: 17/532,998

(22) Filed: Nov. 22, 2021

(65) Prior Publication Data

US 2022/0149527 A1 May 12, 2022

Related U.S. Application Data

(63) Continuation of application No. PCT/CN2020/090960, filed on May 19, 2020.

(30) Foreign Application Priority Data

May 21, 2019 (CN) ..... 201910424799.X

(51) Int. Cl.
*H01Q 9/20* (2006.01)
*H01Q 5/48* (2015.01)
(Continued)

(52) U.S. Cl.
CPC ..... *H01Q 9/20* (2013.01); *H01Q 1/523* (2013.01); *H01Q 5/48* (2015.01); *H01Q 9/285* (2013.01);
(Continued)

(58) Field of Classification Search
CPC ..... H01Q 9/285; H01Q 21/062; H01Q 9/20; H01Q 5/48; H01Q 19/108; H01Q 1/523;
(Continued)

(56) References Cited

U.S. PATENT DOCUMENTS 9,912,076 B2 * 3/2018 Bisiules ..... H01Q 21/30
10,439,285 B2 * 10/2019 Isik ..... H01Q 1/24
(Continued)

FOREIGN PATENT DOCUMENTS

CN 201725867 U 1/2011
CN 203589207 U 5/2014
(Continued)

OTHER PUBLICATIONS

Bernety Hossein Met al: "Reduction of Mutual Coupling Between Neighboring Strip Dipole Antennas Using Confocal Elliptical Metasurface Cloaks", Jan. 29, 2015 (Jan. 29, 2015), pp. 1554-1563, XP011577974.

*Primary Examiner* — Vibol Tan
(74) *Attorney, Agent, or Firm* — James Anderson Harrison

(57) ABSTRACT

This application provides a radiating element, an antenna array, and a network device, to avoid mutual shielding between dipoles during multi-band transmission, and therefore improve radiation performance. The radiating element includes one or more dipoles and a supporter. The one or more dipoles are suspended on the top of the supporter, and each of the one or more dipoles is connected to the supporter at a specific angle. A dipole arm of each dipole is covered with a periodic structure. The periodic structure is configured to enable an electromagnetic wave radiated to a first surface of each dipole to be incident to a second surface of each dipole, where the first surface and the second surface are any two opposite surfaces of each dipole.

7 Claims, 10 Drawing Sheets

(51) Int. Cl.

| | |
|---|---|
| ***H01Q 19/10*** | (2006.01) |
| ***H01Q 21/06*** | (2006.01) |
| ***H01Q 1/52*** | (2006.01) |
| ***H01Q 9/28*** | (2006.01) |

(52) U.S. Cl.
CPC ..... *H01Q 19/108* (2013.01); *H01Q 21/062* (2013.01)

(58) Field of Classification Search
CPC ..... H01Q 5/42; H01Q 1/246; H01Q 15/02; H01Q 21/26; H01Q 1/36; H01Q 19/06; H01Q 19/104; H01Q 21/24; H01Q 21/30
See application file for complete search history.

(56) References Cited

U.S. PATENT DOCUMENTS

| | | | | |
|---|---|---|---|---|
| 10,601,120 | B2 * | 3/2020 | Bisiules | H01Q 1/246 |
| 2016/0111782 | A1 | 4/2016 | Alu et al. | |
| 2016/0365645 | A1 | 12/2016 | Bisiules | |
| 2017/0125917 | A1 | 5/2017 | Lin et al. | |
| 2017/0310009 | A1 * | 10/2017 | Isik | H01Q 1/24 |
| 2017/0373385 | A1 | 12/2017 | Alu et al. | |
| 2018/0337443 | A1 * | 11/2018 | Bisiules | H01Q 1/246 |
| 2019/0036226 | A1 | 1/2019 | Ding et al. | |

FOREIGN PATENT DOCUMENTS

| | | | |
|---|---|---|---|
| CN | 204732528 | U | 10/2015 |
| CN | 105281031 | A | 1/2016 |
| CN | 107275804 | A | 10/2017 |
| CN | 109728416 | A | 5/2019 |
| WO | 2010118171 | A1 | 10/2010 |
| WO | 2017127062 | A1 | 7/2017 |
| WO | 2018212825 | A1 | 11/2018 |
| WO | 2019084232 | A1 | 5/2019 |

* cited by examiner

RADIATING ELEMENT, ANTENNA ARRAY, AND NETWORK DEVICE

CROSS-REFERENCE TO RELATED APPLICATIONS

This application is a continuation of International Application No. PCT/CN2020/090960, filed on May 19, 2020, which claims priority to Chinese Patent Application No. 201910424799.X, filed on May 21, 2019. The disclosures of the aforementioned applications are herein incorporated by reference in their entireties.

TECHNICAL FIELD

This application relates to the communication field, and in particular, to a radiating element, an antenna array, and a network device.

BACKGROUND

With development of high-capacity, multichannel, and high-throughput mobile communication, integration of an antenna continuously improves. Consequently, arrangement of dipoles in an antenna array element spacing becomes increasingly crowded; and in particular, if a plurality of frequency bands coexist, arrangement of antenna elements in different frequency bands is faced with two types of enormous challenges.

Usually, a low-frequency dipole and a high-frequency dipole are closely arranged in a cross manner in an antenna array. As more frequency bands are supported by an antenna, more dipoles are arranged. However, when the antenna works, the dipoles are shielded from each other. As a result, radiation directions of the shielded dipoles are distorted. For example, when the low-frequency dipole shields the high-frequency dipole, a radiation direction of the high-frequency dipole changes. This causes distortion of a pattern of a high-frequency array and affects radiation performance.

SUMMARY

This application provides a radiating element, an antenna array, and a network device, to avoid mutual shielding between dipoles during multi-band transmission, and therefore improve radiation performance.

In view of this, a first aspect of this application provides a radiating element. The radiating element may include one or more dipoles and a supporter.

The one or more dipoles are suspended on a top of the supporter, and each of the one or more dipoles is connected to the supporter at a specific angle.

A dipole arm of each dipole is covered with a periodic structure. The periodic structure is configured to enable an electromagnetic wave radiated to a first surface of each dipole to be incident to a second surface of each dipole, where the first surface and the second surface are any two opposite surfaces of each dipole.

According to the radiating element provided in this embodiment of this application, the dipole is covered with the periodic structure, so that an equivalent dielectric constant or an equivalent permeability of the dipole is changed, and the electromagnetic wave radiated to the dipole may be diffracted. In this way, the electromagnetic wave may be incident from a side of the dipole to an opposite side of the dipole. This reduces a change of a direction of the electromagnetic wave radiated to the dipole and improves radiation performance.

Optionally, in some possible implementations, the periodic structure may include a metal conductor. In this embodiment of this application, the periodic structure may be made of an electromagnetic material. Usually, the periodic structure may include the metal conductor, so that the periodic structure may change the equivalent dielectric constant or the equivalent permeability of the dipole, and the electromagnetic wave radiated to the dipole may be diffracted. In this way, the electromagnetic wave may be incident from a side of the dipole to an opposite side of the dipole. This reduces the change of the direction of the electromagnetic wave radiated to the dipole and improves radiation performance.

Optionally, in some possible implementations, the periodic structure includes a plurality of metal rings, and the plurality of metal rings are sleeved over the dipole arm of each dipole; or the periodic structure includes a plurality of planes, each of the plurality of planes consists of a ring structure, and the periodic structure is sleeved over the dipole arm of each dipole. In this embodiment of this application, the periodic structure may cover the dipole in a plurality of manners, and may directly include the metal rings that are sleeved over the dipole arm, or may include the plurality of planes, where each plane consists of one or more metal rings, and the plurality of planes may be coupled to the dipole arm, so that the periodic structure may be sleeved over the dipole arm. In this way, the equivalent dielectric constant, the equivalent permeability, or the like of the dipole is changed.

Optionally, in some possible implementations, the periodic structure may include a circular metal ring or a square metal ring. In this embodiment of this application, the periodic structure may include a plurality of types of metal rings, and may include the circular metal ring, the square metal ring, or another metal ring, for example, a rhombic metal ring or a trapezoidal metal ring.

Optionally, in some possible implementations, the plurality of dipoles include a first dipole and a second dipole.

The first dipole and the second dipole are perpendicularly arranged in a cross manner, and a radiation direction of the first dipole is different from a radiation direction of the second dipole. In this embodiment of this application, the radiating element may include the plurality of dipoles, where the plurality of dipoles may include the first dipole and the second dipole. The first dipole and the second dipole are perpendicularly arranged in the cross manner and the radiation direction of the first dipole is different from the radiation direction of the second dipole, so that a dual-polarized radiating element may be formed, and one radiating element radiates an electromagnetic wave in different directions.

Optionally, in some possible implementations, a groove is disposed on the first dipole, and the second dipole is inter-connected to the first dipole via the groove. In this embodiment of this application, the groove may be disposed on the first dipole, so that the second dipole is inter-connected to the first dipole via the groove. Optionally, an opening that is coupled to the groove on the first dipole may be disposed on the second dipole, so that inter-connection between the first dipole and the second dipole is more stable.

Optionally, in some possible implementations, a bottom of the supporter is fixedly connected to a reflector, each dipole is parallel to the reflector, and the reflector is configured to reflect the electromagnetic wave. In this embodiment of this application, the bottom of the supporter may be fixedly connected to the reflector, and the reflector may be configured to reflect the electromagnetic wave.

A second aspect of this application provides an antenna array, including a reflector and at least two radiating elements.

The at least two radiating elements are arranged on the reflector, and the at least two radiating elements may include the radiating element according to any one of the first aspect or the optional implementations of the first aspect.

In this embodiment of this application, an antenna array may include the reflector and a plurality of radiating elements. The reflector may be configured to reflect an electromagnetic wave. A dipole arm of each dipole on the radiating element is covered with a periodic structure. The periodic structure may change an equivalent dielectric constant or an equivalent permeability of the dipole, so that an electromagnetic wave radiated to the dipole may be diffracted. In this way, the electromagnetic wave may be incident from a side of the dipole to an opposite side of the dipole. This reduces a change of a direction of the electromagnetic wave radiated to the dipole and improves radiation performance.

Optionally, in some possible implementations, the at least two radiating elements include a first radiating element and a second radiating element.

An operating frequency band of the first radiating element is different from an operating frequency band of the second radiating element.

In this embodiment of this application, the antenna may include the first radiating element and the second radiating element. The operating frequency band of the first radiating element may be different from the operating frequency band of the second radiating element, so that the antenna array may simultaneously radiate electromagnetic waves in different frequency bands.

A third aspect of this application provides a network device. The network device may include the radiating element according to any one of the first aspect or the optional implementations of the first aspect.

In the embodiments of this application, the radiating element may include the one or more dipole arms and the supporter. The dipole arm may be covered with the periodic structure. The periodic structure is made of the electromagnetic material, and a gap exists in the periodic structure. The periodic structure may change at least one of the equivalent dielectric constant or the equivalent permeability of the dipole relative to the electromagnetic wave incident to the dipole, so that the electromagnetic wave radiated to the first surface of each dipole is incident to the second surface of each dipole. Therefore, according to the radiating element provided in the embodiments of this application, when an electromagnetic wave radiated by another dipole is received, the electromagnetic wave may be normally incident in a diffraction manner, thereby reducing shielding of the radiated electromagnetic wave, so that distortion of a radiation direction caused by shielding of the dipole may be avoided, and radiation performance of the antenna array may be improved.

DESCRIPTION OF EMBODIMENTS

This application provides a radiating element, an antenna array, and a network device, to avoid mutual shielding between dipoles during multi-band transmission, and therefore improve radiation performance.

The network device provided in this application may be various devices having a wireless receiving or sending function. The network device may be a terminal, a base station, or the like. More specifically, the terminal may be a mobile phone, a tablet computer, a wearable device, a vehicle-mounted terminal, a router, a mobile station (MS), a mobile terminal (MT), or the like. The base station may be a macro base station, a micro base station (micro BS), a pico BS, a femto BS, a transmission point (TP), a relay (Relay), an access point (AP), or the like. The base station may be an eNodeB (eNB) in long term evolution (LTE), a gNodeB (gNB) in new radio (NR), or the like.

Still further, the network device may be applied to various communication systems, for example, a base station (BS) in a global system for mobile communications (GSM) system, a wideband code division multiple access (WCDMA) system, an LTE system, or an NR system, and may be further applied to a future communication network, for example, a 6G network or a 7G network. More specifically, the network device may be further applied to ultra-reliable low-latency communication (URLLC) in 5G, may support massive machine-type communication (mMTC), and may be further applied to a mobile broadband (MBB) service, or the like.

Figure 1:
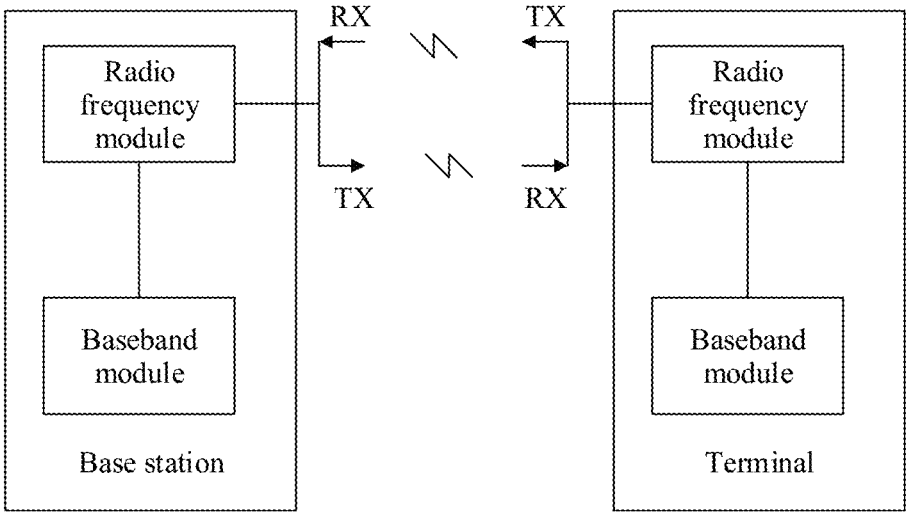
FIG. 1 is a schematic diagram of an application scenario according to an embodiment of this application.

For example, communication between a base station and a terminal is used as an example for description. Refer to FIG. 1. FIG. 1 is a schematic diagram of an application scenario according to an embodiment of this application.

Wireless data transmission is performed between the base station and the terminal. A baseband module may convert, into a baseband signal, data that needs to be transmitted, and radiate the baseband signal by using an antenna array of a radio frequency module. The baseband module may further decode a signal received by an antenna array, to obtain a digital signal; and so on. Both the base station and the terminal may include a radio frequency module and a baseband module to implement data transmission between the base station and the terminal. The terminal may send an uplink signal via the radio frequency module and may receive a downlink signal sent by the base station.

The network device provided in this application may include one or more antenna arrays, where one antenna array may include a plurality of radiating elements. Usually, as the network device supports more frequency bands, more radiating elements are required in the antenna array. One radiating element may radiate one or more frequency bands and one antenna array may include one or more radiating elements. When the plurality of radiating elements are included, shielding may occur between dipoles of the radiating elements. For example, a frequency band 1700 MHz to 2700 MHz is naturally second order harmonics of a frequency band 690 MHz to 960 MHz, and there is a natural resonant condition for the two bands. Consequently, mutual interference is prone to occur. Therefore, when supporting both the two frequency bands, the network device usually supports the frequency bands via two radiating elements respectively. This may be understood as that a dipole supporting the frequency band 690 MHz to 960 MHz is a low-frequency dipole, and a dipole supporting the frequency band 1700 MHz to 2700 MHz is a high-frequency dipole. The low-frequency dipole is likely to shield the high-frequency dipole. This affects a radiation direction of the high-frequency dipole and radiation performance.

The antenna array provided in this application may include one or more radiating elements. When the antenna array includes a plurality of radiating elements, operating frequency bands of the plurality of radiating elements may be the same or different. For example, the plurality of radiating elements may include a first radiating element and a second radiating element. An operating frequency band of the first radiating element may be the same as or different from an operating frequency band of the second radiating element. The antenna array may further include a reflector in addition to the radiating element. The reflector may be configured to reflect an electromagnetic wave. The plurality of radiating elements may be arranged on the reflector. For example, high frequency dipoles and low frequency dipoles coexist in the antenna array, the antenna array may include six rows and four columns of high frequency dipoles and three rows and two columns of low frequency dipoles, and the high frequency dipoles may be arranged around the low frequency dipoles.

Figure 2:
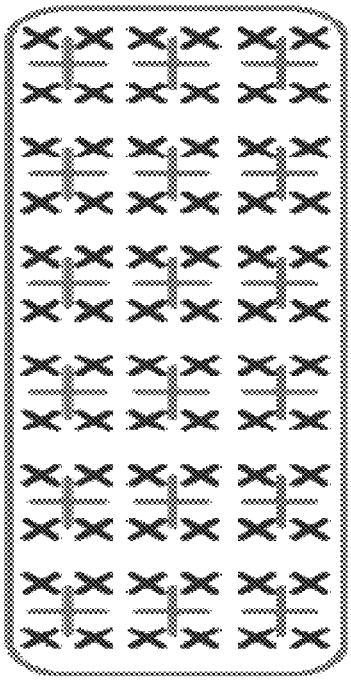
FIG. 2 is a schematic diagram of a structure of an antenna array according to an embodiment of this application.

For example, a structure of the antenna array may be that shown in FIG. 2. The "x" may represent a high-frequency dual-polarized antenna dipole, and the "+" may represent a low-frequency dual-polarized antenna dipole. The high-frequency dipole is closely arranged around the low-frequency dipole. Usually, a size of an antenna is related to a wavelength of a supported frequency band. A larger wavelength indicates a larger size of the antenna. Therefore, a size of the low-frequency antenna dipole may be greater than a size of the high-frequency antenna dipole, and the low-frequency dipole may shield an electromagnetic wave radiated by the high-frequency dipole. This affects a radiation direction of the high-frequency dipole, and further affects radiation performance of the high-frequency dipole.

It should be noted that, the high frequency is relative to the low frequency in this application, and the high frequency is higher than the low frequency. Generally, a frequency greater than a frequency threshold may be understood as the high frequency, and a frequency not greater than the frequency threshold may be understood as the low frequency. For example, the frequency band 690 MHz to 960 MHz may be understood as a low frequency band, and the frequency band 1700 MHz to 2700 MHz may be understood as a high frequency band. A range of the high frequency and a range of the low frequency may be adjusted based on an actual application scenario, and are not limited herein.

In this application, a dipole may be covered with a periodic structure, so that an electromagnetic wave radiated to the dipole is incident from a first surface of the dipole to a second surface by directly passing through the dipole or in a diffraction manner. The periodic structure comprises a structure having a spanwise repeating shape, such as shown in FIGS. 6-9, for example. Therefore, wave transmission performance of the dipole may be improved, so that shielding between dipoles may be avoided, and radiation performance may be improved. The dipole may be applied to the foregoing network device or antenna array, to improve radiation performance of the network device or the antenna array.

The radiating element provided in this application is described below.

The radiating element provided in this application may include one or more dipoles and a supporter. The one or more dipoles are suspended on the top of the supporter, and the one or more dipoles are connected to the supporter at a specific angle.

For example, the angle may be any angle ranging from 80° to 10°, or may be a right angle or an approximately right angle.

A dipole arm of each of the one or more dipoles is covered with a periodic structure. The periodic structure may be configured to enable an electromagnetic wave radiated to a first surface of each dipole to be incident to a second surface of the dipole, where the first surface and the second surface are two opposite surfaces of each dipole.

In this application, there may be one dipole, or there may be a plurality of dipoles, and the plurality of dipoles refer to two or more dipoles. In the following embodiments of this application, two dipoles are used as an example to describe the radiating element in more detail.

Figure 3A:
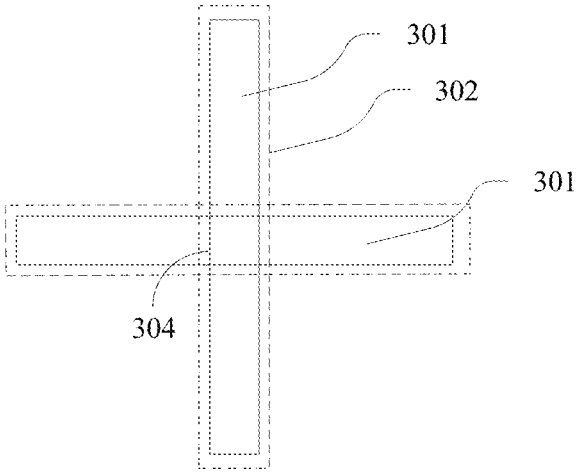
FIG. 3A is a schematic diagram of a structure of a radiating element according to an embodiment of this application.
Figure 3B:
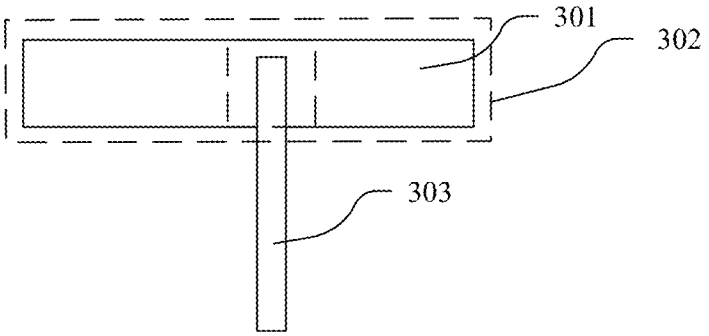
FIG. 3B is another schematic diagram of a structure of a radiating element according to an embodiment of this application.

Refer to FIG. 3A and FIG. 3B for schematic diagrams of a structure of a radiating element according to an embodiment of this application.

The radiating element may include dipoles 301, a periodic structure 302, and a supporter 303.

The two dipoles 301, namely, a first dipole and a second dipole, may be arranged in a cross manner and suspended on the top of the supporter 303. When there is one dipole 301, the dipole 301 may be directly suspended on the top of the supporter 303.

For example, a groove 304 may be disposed in the middle of each dipole 301, and the two dipoles 301 may be arranged in the cross manner by inter-connection. For example, if the radiating element includes two dipoles 301, one or two grooves 304 are disposed in the middle of the two dipoles 301, and the grooves 304 disposed on the two dipoles 301 may be coupled or brought into contact when assembled, so that the two dipoles 301 may be arranged in the cross manner and perpendicular to each other. Then, the two dipoles 301 are suspended on the top of the supporter 303. Certainly, in addition to the manner in which the first dipole 301 and the second dipole 301 are arranged in the cross manner by inter-connection through the grooves 304, other manners may be used. For example, the first dipole 301 and the second dipole 301 may be welded, or may be bonded and fixed by using a solvent. This embodiment of this application is merely an example for description, and a specific manner may be adjusted based on an actual application scenario, and is not limited in this application.

Optionally, in some possible implementations, radiation directions of the first dipole 301 and the second dipole 301 are different. For example, the first dipole 301 may radiate an electromagnetic wave in a horizontal direction, and the second dipole 301 may radiate an electromagnetic wave in a vertical direction. In this way, a dual-polarized antenna is formed.

A dipole arm of each dipole 301 is covered with the periodic structure 302. The periodic structure 302 is a periodic electromagnetic structure, and is an unclosed structure. For example, a slit may be disposed on the periodic structure 302, or the periodic structure 302 is obtained after a linear conductor made of an electromagnetic material is folded.

It should be understood that the periodic structure 302 may cover a part of the dipole arm of the dipole 301, or may cover the entire dipole 301. A specific coverage range may be adjusted based on an actual application scenario, and is not limited in this application. Generally, a larger range that is of the dipole arm and that is covered by the periodic structure 302 indicates a smaller quantity of shielded electromagnetic waves, a larger quantity of incident electromagnetic waves, and smaller impact on a radiation direction of another dipole 301. Therefore, the periodic structure 302 may cover a relatively large range of the dipole arm.

In addition, a structure of the dipole 301 may specifically include a dielectric plate, a feeding layer, and the like. Details are not described in this application. The dipole 301 may alternatively include more or fewer structures. This may be specifically adjusted based on an actual application scenario. In addition, the length, the width, and the like of the dipole 301 may also be adjusted based on an electromagnetic wave that is in a frequency band and that actually needs to be radiated, and the shape of the dipole 301 may be a flat cuboid, a cylinder, or another shape. The shape, the material, the length, and the like of the dipole 301 are not limited in this application.

In this embodiment of this application, the periodic structure 302 covering the dipole arm may change at least one of an equivalent dielectric constant or an equivalent permeability of the relative to an electromagnetic wave incident to the dipole 301, so that an electromagnetic wave radiated to a first surface of each dipole 301 is incident to a second surface of each dipole 301. Therefore, according to the radiating element provided in this embodiment of this application, when an electromagnetic wave radiated by another dipole 301 is received, the electromagnetic wave may be normally incident, to avoid shielding between the dipoles 301, so that distortion of a radiation direction caused by shielding of the dipole 301 may be avoided and radiation performance of the dipole 301 may be improved. In addition, because the dipole arm is covered with the periodic structure 302 made of the electromagnetic material, an equivalent electrical size of the dipole arm may be increased, and an operating bandwidth of the dipole 301 may be increased, thereby realizing a broadband-oriented dipole 301. This may be understood as that covering the dipole arm with the periodic structure 302 is equivalent to adding a stealth material on the dipole arm. This is to implement stealth of the dipole 301 in an antenna array and eliminate shielding between the dipoles 301. In addition, because the periodic structure 302 covers the dipole arm and the periodic structure 302 is the electromagnetic structure, the operating bandwidth of the dipole 301 may be increased.

Figure 4:
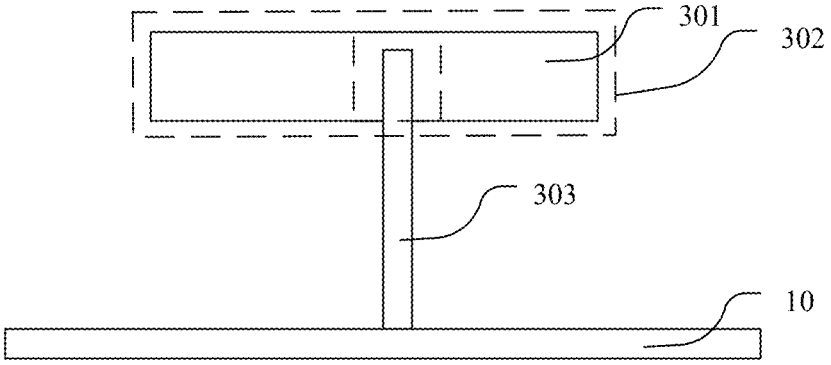
FIG. 4 is another schematic diagram of a structure of a radiating element according to an embodiment of this application.

Usually, in some optional implementations, the bottom of the supporter 303 may be further fixed on a reflector. As shown in FIG. 4, the supporter 303 may be fixed on a reflector 10.

The reflector 10 may be a printed circuit board (PCB), or may be understood as a base board. The reflector may be configured to reflect an electromagnetic wave signal. Usually, the reflector may be made of metal, or may include a PCB including a metallic coating. The reflector 10 may include a plurality of layers, for example, one or more of a metal layer, a dielectric layer, a conductor layer, or a ground layer.

Optionally, in some possible implementations, the periodic structure 302 may be a structure made of the electromagnetic material, and the electromagnetic material may be a metal material. A specific material of a metal periodic structure 302 may be various metals such as copper, iron, aluminum, or gold.

Optionally, in some possible implementations, the periodic structure 302 may be a ring metal periodic structure 302. The ring metal periodic structure 302 is made of metal and includes one or more ring structures.

The ring metal periodic structure 302 may cover a surface of the dipole arm of each dipole 301. The ring metal periodic structure 302 may be configured to change at least one of the equivalent dielectric constant or the equivalent permeability of the dipole 301 relative to the electromagnetic wave radiated to the dipole 301, so that the electromagnetic wave radiated to the dipole 301 may be diffracted, and then the electromagnetic wave may pass through the dipole 301. In this way, normal transmission of the electromagnetic wave is implemented, and shielding of the electromagnetic wave by the dipole 301 may be reduced.

Optionally, the ring metal periodic structure 302 may be a ring periodic structure 302, and is made of a metal material. The ring metal periodic structure 302 covers the dipole arm in a plurality of manners. For example, the ring metal periodic structure 302 may be ring-shaped and be wound around the dipole arm; or the ring metal periodic structure 302 includes a plurality of metal rings, where the plurality of metal rings are sleeved over the dipole arm; or the ring metal periodic structure 302 may include a plurality of planes, where each of the plurality of planes includes a metal ring, and the ring metal periodic structure 302 may be coupled to the dipole 301, so that the ring metal periodic structure 302 may be directly and integrally sleeved over the dipole arm.

Figure 5:
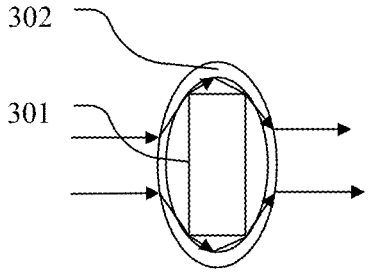
FIG. 5 is a schematic diagram of an electromagnetic wave transmission path in a radiating element according to an embodiment of this application.

For example, when the ring metal periodic structure 302 is sleeved over the dipole arm, a diffraction direction of the electromagnetic wave may be shown in FIG. 5. When the electromagnetic wave is radiated to the periodic structure 302 that is sleeved over the dipole 301, the periodic structure 302 may change a refractive index of the dipole 301, and the dipole 301 whose refractive index has been changed enables the electromagnetic wave to be diffracted to pass through the dipole 301. Therefore, in this embodiment of this application, the periodic structure 302 sleeved over the dipole 301 enables the equivalent dielectric constant or the equivalent permeability of the dipole 301 to change, and enable the electromagnetic wave radiated to the dipole 301 to be diffracted. In this way, the electromagnetic wave may pass through the dipole 301, and distortion of a direction of the electromagnetic wave radiated to the dipole 301 is reduced, thereby improving radiation performance.

Figure 6:
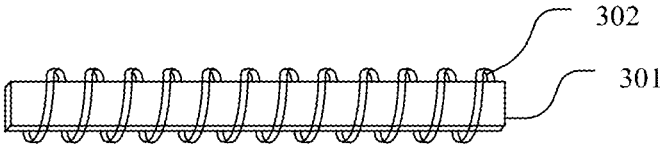
FIG. 6 is another schematic diagram of a structure of a radiating element according to an embodiment of this application.

Optionally, the ring metal periodic structure 302 may include a circular metal ring, and the circular metal ring may be wound around the dipole arm of each dipole 301. There may be one or more circular metal rings. As shown in FIG. 6, the ring metal periodic structure 302 includes circular metal rings 302 wound around the dipole arm. The circular metal ring may be formed by directly winding a linear electromagnetic material around the dipole arm. A specific winding density, a specific winding range, and the like of the circular metal ring 302 around the dipole arm may be adjusted based on an actual requirement.

Figure 7:
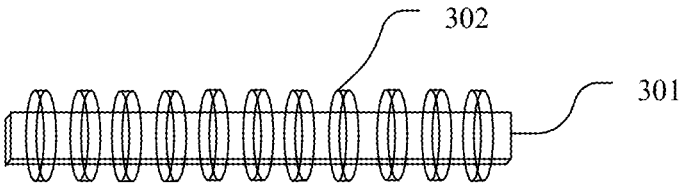
FIG. 7 is another schematic diagram of a structure of a radiating element according to an embodiment of this application.

Reference may alternatively be made to FIG. 7 for another manner in addition to the winding manner in FIG. 6. The ring metal periodic structure 302 may include a plurality of circular metal rings, and each circular metal ring independently exists. A gap exists between the circular metal rings. Each circular metal ring is sleeved over the dipole arm, and the circular metal rings may face each other. More specifically, the circular metal ring may be first formed and then be wound around the dipole arm; or the circular metal ring may be directly manufactured on the dipole arm, so that the circular metal ring is wound around the dipole arm. In addition, the circular metal ring may be fixed on the dipole arm, so that the circular metal ring does not slide and not affect wave transmission performance of the dipole arm.

Figure 8:
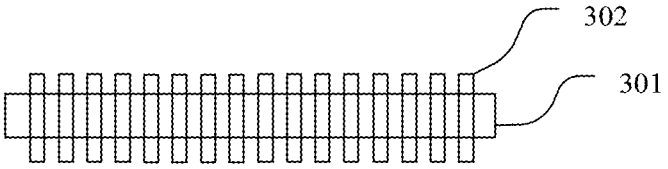
FIG. 8 is another schematic diagram of a structure of a radiating element according to an embodiment of this application.

In addition, as shown in FIG. 8, the metal ring may alternatively be a square ring in addition to the circular metal ring. The metal ring is a square metal ring. A plurality of square metal rings may be sleeved over the dipole arm, and a gap exists between the square metal rings. Specifically, the square metal ring may also be fixed on the dipole arm, so that the metal ring does not slide and not affect wave transmission performance of the dipole arm.

Figure 9:
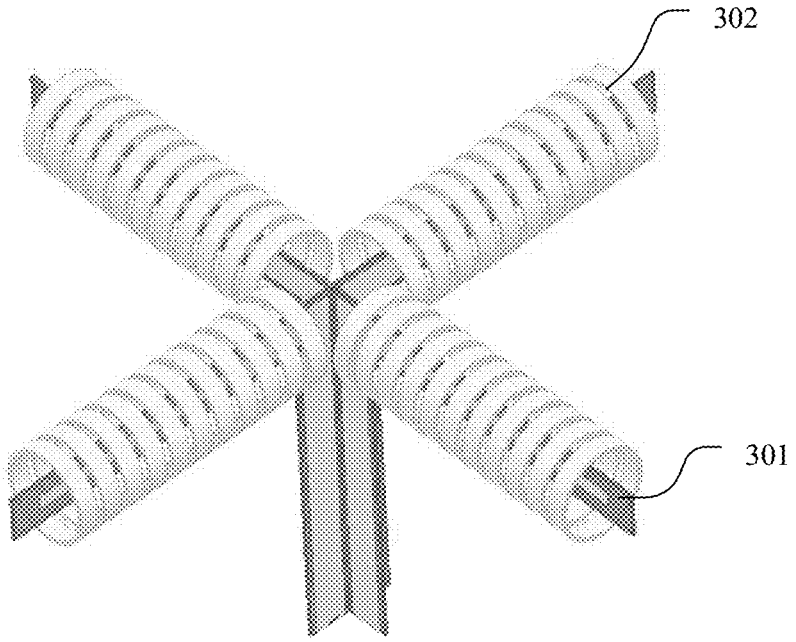
FIG. 9 is another schematic diagram of a structure of a radiating element according to an embodiment of this application.

For example, FIG. 9 may be a schematic diagram of a specific structure of a radiating element according to an embodiment of this application. A periodic structure 302 in some embodiments comprises a ring metal periodic structure 302, and may include a plurality of circular metal rings 302. The plurality of circular metal rings 302 are sleeved over a dipole 301, and a gap exists between the circular metal rings. When an electromagnetic wave is radiated to the dipole 301, the circular metal ring may change an equivalent dielectric constant or an equivalent permeability of the dipole 301 relative to the electromagnetic wave, so that the electromagnetic wave is diffracted to pass through the dipole 301. This reduces impact on a radiation direction of the electromagnetic wave. In addition, sleeving the metal rings over the dipole 301 increases an equivalent electrical size of the dipole 301, and may further increase an operating bandwidth of the dipole 301.

In all the radiating elements provided in the foregoing FIG. 4 to FIG. 9, the ring metal periodic structure 302 is sleeved over the dipole arm of the dipole 301. In addition to the manner in which the metal ring is directly sleeved over the dipole arm, there may alternatively be another manner in which the periodic structure 302 includes a plurality of planes, where each plane includes a periodic shape and the periodic structure 302 is coupled to the dipole 301. In this way, the periodic structure 302 may be integrally sleeved over the dipole arm. Details are described below.

Figure 10:
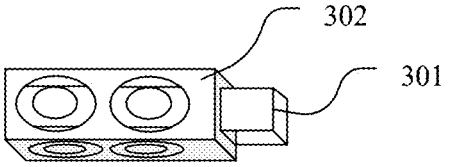
FIG. 10 is another schematic diagram of a structure of a radiating element according to an embodiment of this application.

Refer to FIG. 10. If the dipole 301 is cuboid, the periodic structure 302 may include at least four planes, where each plane may include a circular metal ring, each plane has a gap, and the periodic structure 302 is sleeved over the dipole 301.

Figure 11:
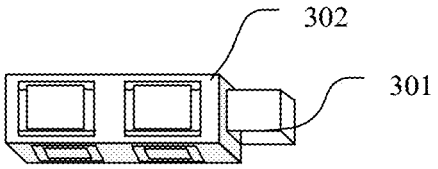
FIG. 11 is another schematic diagram of a structure of a radiating element according to an embodiment of this application.

The periodic structure 302 may alternatively include a square ring in addition to the circular metal ring. As shown in FIG. 11, if the dipole 301 is cuboid, the periodic structure 302 may include at least four planes, where each plane may include a square metal ring, each plane has a gap, and the periodic structure 302 is sleeved over the dipole 301.

It should be noted that the periodic shape in this embodiment of this application is not limited to the circular metal ring or the square ring, and may alternatively be, for example, oval, H-shaped, or I-shaped.

Figure 12:
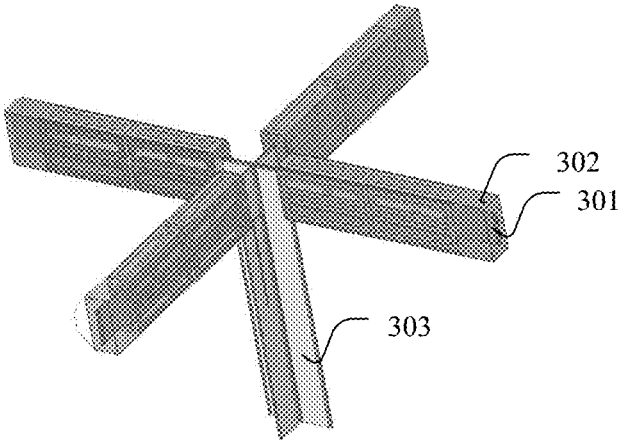
FIG. 12 is another schematic diagram of a structure of a radiating element according to an embodiment of this application.

For example, as shown in FIG. 12, the periodic structure 302 may be a metal periodic structure 302 including a square ring. The two dipoles 301 are suspended on the supporter 303, and the periodic structure 302 is sleeved over the dipole 301. The metal periodic structure 302 includes a plurality of planes, where each plane may include a plurality of square structures, and the metal periodic structure 302 may be coupled to the dipole 301 and is sleeved over the dipole 301.

In this embodiment of this application, the periodic structure 302 may include the plurality of planes, where each plane includes a ring periodic structure 302, and the periodic structure 302 may be coupled to the dipole 301 and is sleeved over the dipole 301. When the electromagnetic wave is radiated to the dipole 301, the periodic structure 302 may change the equivalent dielectric constant or equivalent permeability of the dipole 301 relative to the electromagnetic wave, so that the electromagnetic wave is diffracted and passes through the dipole 301 in a diffraction manner, thereby reducing impact on the radiation direction of the electromagnetic wave. In addition, sleeving the metal periodic structure 302 over the dipole 301 is equivalent to increasing the equivalent electrical size of the dipole 301, so that the operating bandwidth of the dipole 301 may be further increased.

The foregoing describes the radiating element provided in the embodiments of this application. The radiating element may be arranged on an antenna array. Specifically, the antenna array provided in this application may include a reflector and one or more radiating elements. The one or more radiating elements may be arranged on the reflector. Specifically, a low-frequency dipole and a high-frequency dipole may be alternately arranged.

Figure 13:
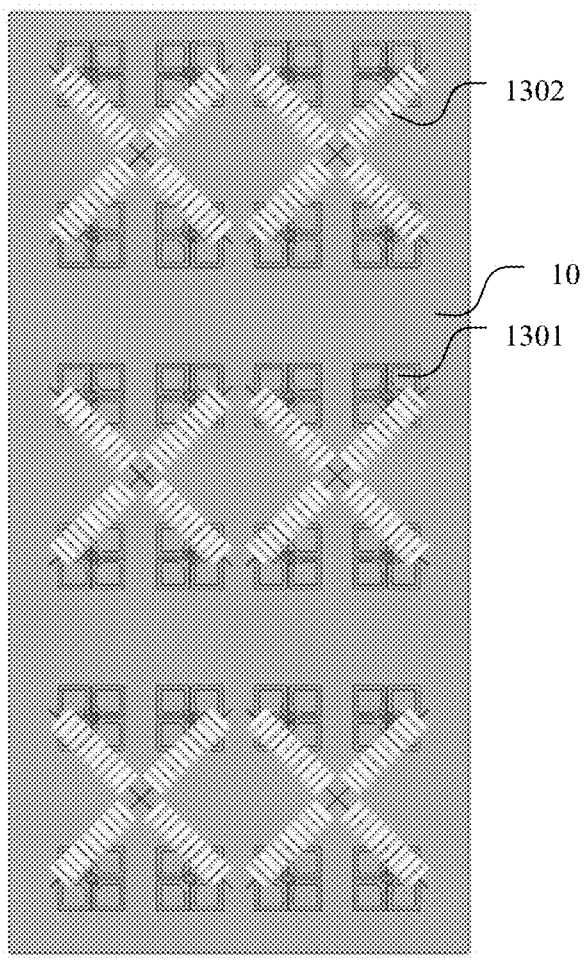
FIG. 13 is another schematic diagram of a structure of an antenna array according to an embodiment of this application.

For example, as shown in FIG. 13, the antenna array may include a reflector 10, six rows and four columns of high-frequency dipoles 1301, and two rows and two columns of low-frequency dipoles 1302. The high-frequency dipole 1301 and the low-frequency dipole 1302 are the radiating element in any one of the foregoing implementations in FIG. 3A to FIG. 12. In this embodiment of this application, the antenna array may include a plurality of radiating elements, in other words, may include a plurality of dipoles. A periodic structure 302 may be sleeved over a dipole arm of the low-frequency dipole, or periodic structures 302 may be sleeved over both the low-frequency dipole 1302 and the high-frequency dipole 1301. The periodic structure 302 may change an equivalent dielectric constant or an equivalent permeability of the dipole relative to an electromagnetic wave radiated to the dipole, so that the electromagnetic wave radiated to the dipole is diffracted. In this way, the electromagnetic wave radiated to the dipole may be incident from a side of the dipole to another side of the dipole, and shielding of the electromagnetic wave is reduced. In addition, sleeving the periodic structure 302 over the dipole may be equivalent to increasing an equivalent electrical size of the dipole, so that an operating bandwidth of the dipole may be increased.

Figure 14A:
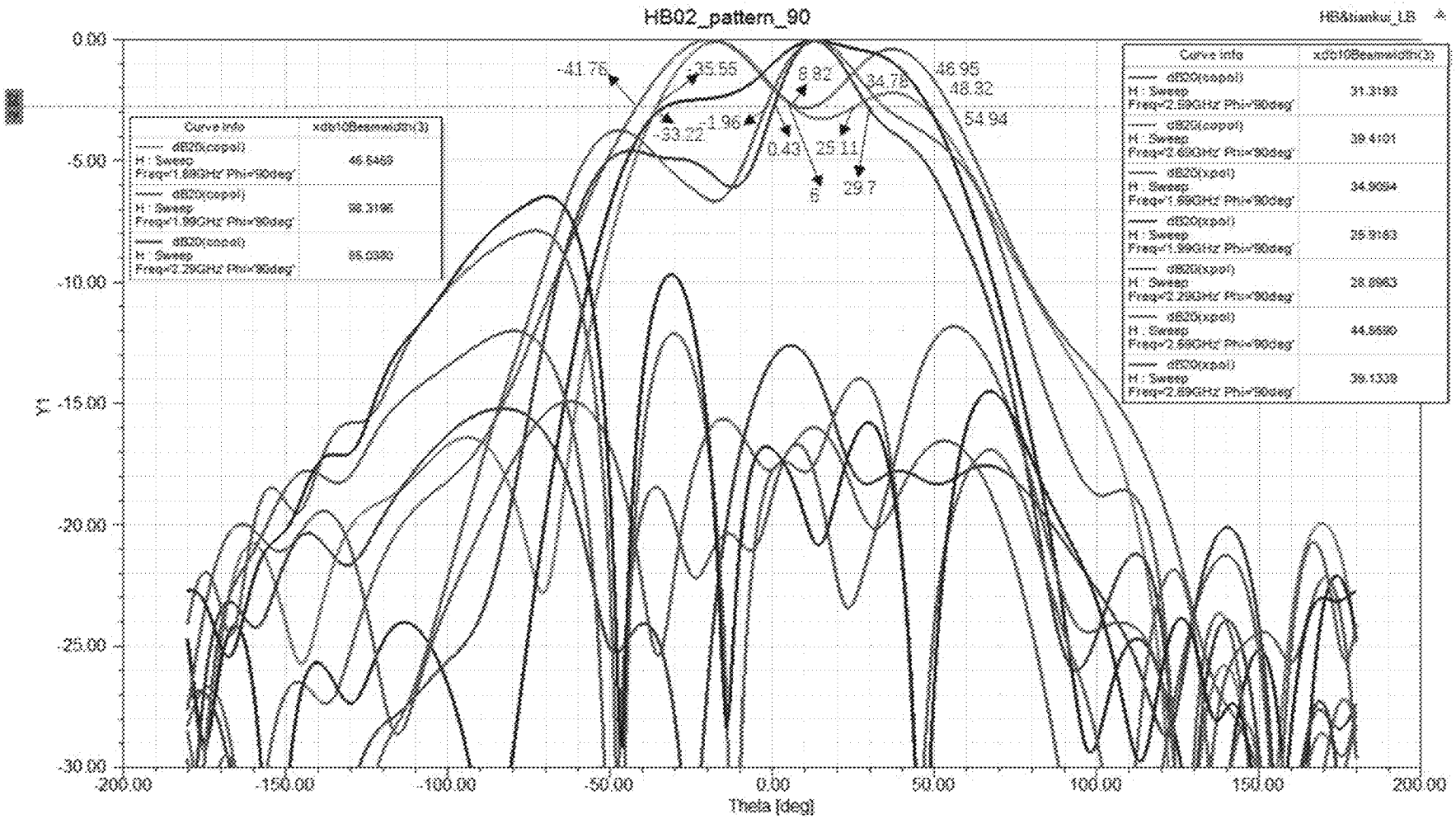
FIG. 14A is a schematic diagram of a radiation direction of an antenna array in an existing solution.
Figure 14B:
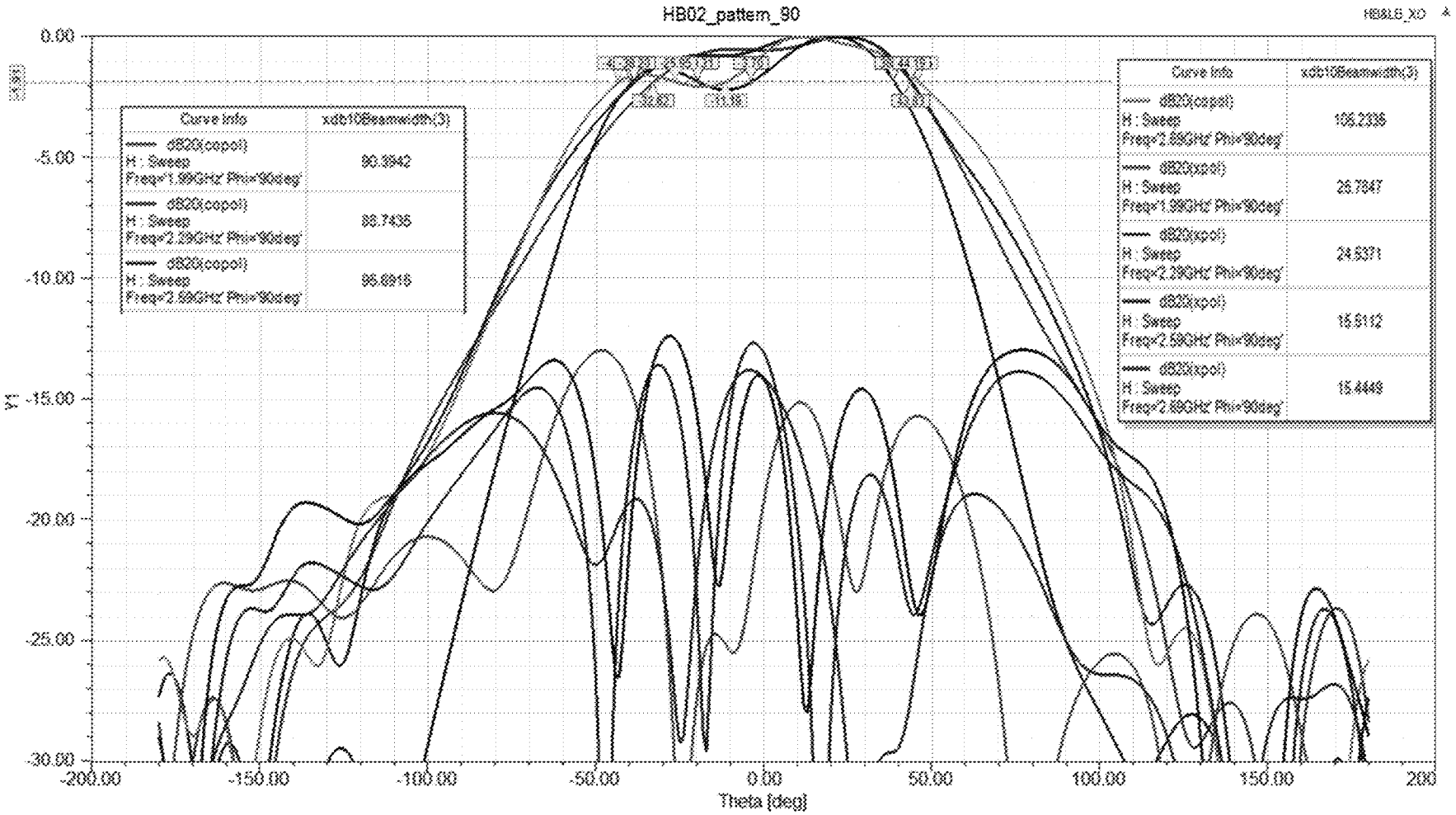
FIG. 14B is a schematic diagram of a radiation direction of an antenna array according to an embodiment of this application.

For example, a specific pattern of the antenna array provided in this application is more vividly described. Refer to FIG. 14A and FIG. 14B. FIG. 14A is a radiation pattern of an antenna array that is not sheathed with a periodic structure, and FIG. 14B is a radiation pattern of an antenna array obtained after the circular metal ring shown in FIG. 8 is sleeved over a dipole arm. The antenna array in which the periodic structure 302 is sleeved over has a better radiation direction than the antenna array in which the periodic structure is not sleeved over, and has fewer sudden changes in radiation directions of a high frequency dipole 1301 and a low frequency dipole 1302. Therefore, radiation performance of the high frequency dipole 1301 and the low frequency dipole 1302 of the antenna array in which the periodic structure 302 is sleeved over the dipole is better.

Figure 15A:
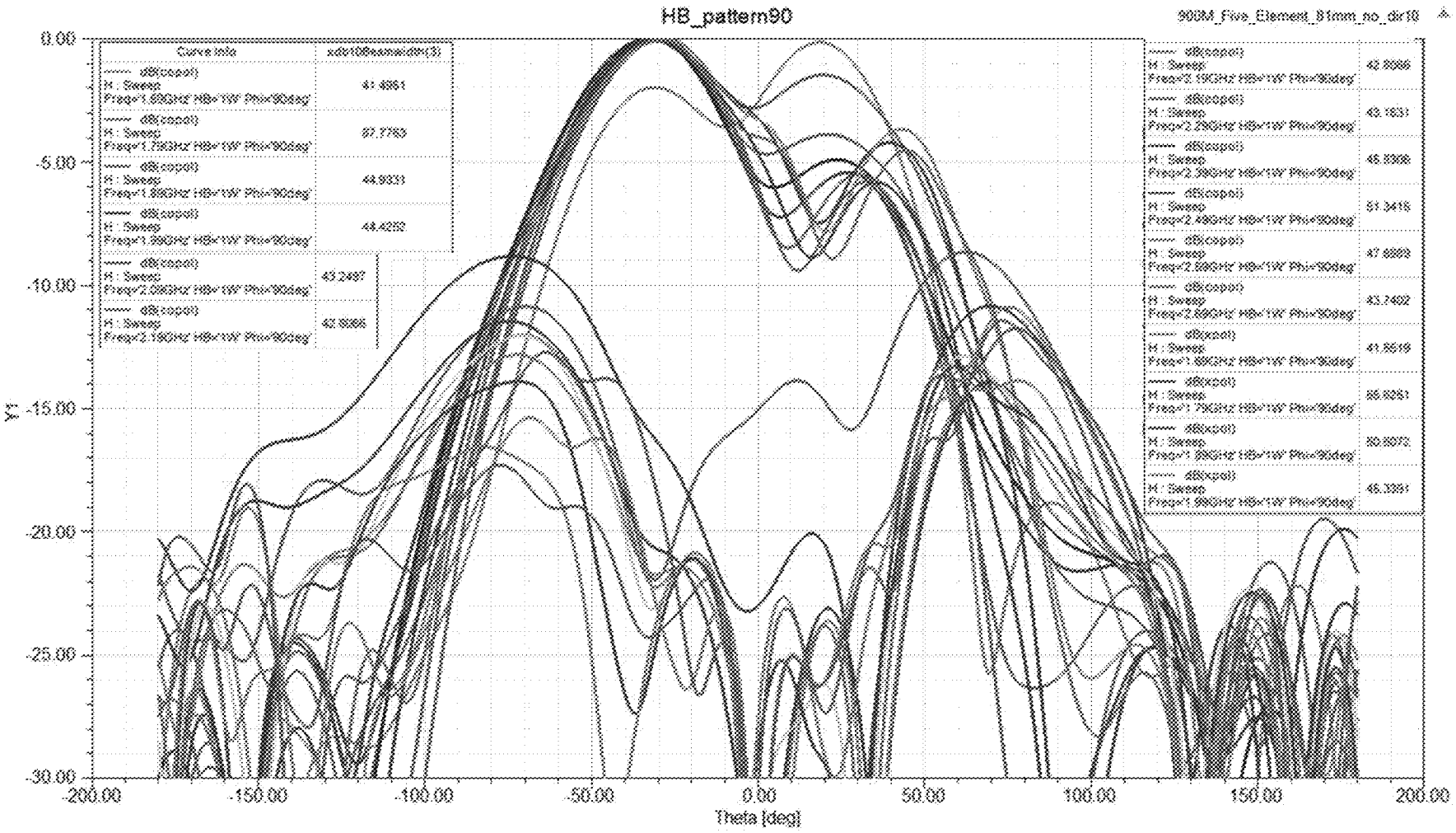
FIG. 15A is another schematic diagram of a radiation direction of an antenna array in an existing solution.
Figure 15B:
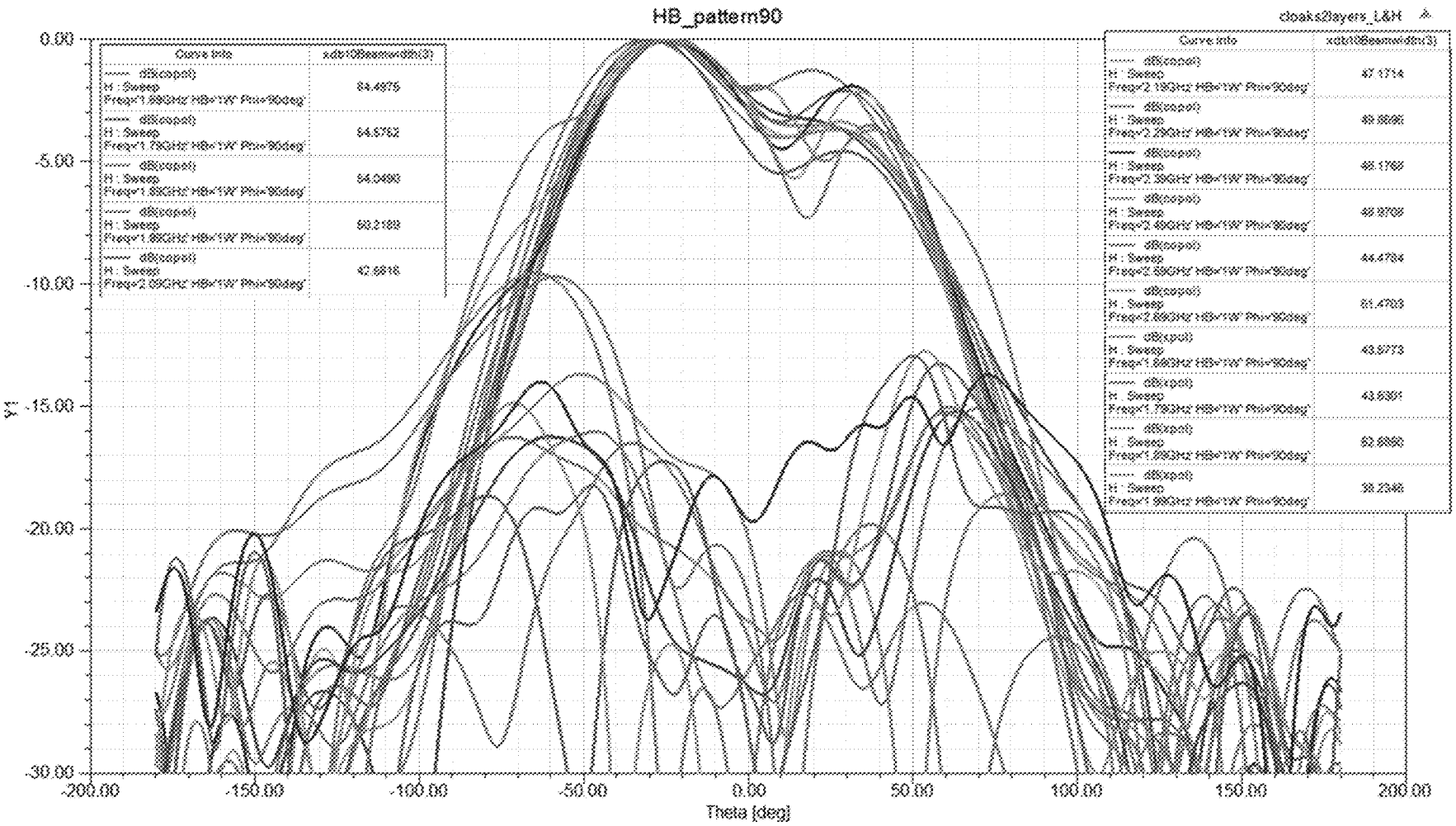
FIG. 15B is a schematic diagram of a radiation direction of an antenna array according to an embodiment of this application.

For example, when the metal periodic structure 302 includes a plurality of planes, each of the plurality of planes includes a ring structure, and the metal periodic structure 302 is sleeved over a dipole arm of each dipole 301, refer to FIG. 15A and FIG. 15B. FIG. 15A is a radiation pattern of an antenna array in which a periodic structure 302 is not sleeved over, and FIG. 15B is a radiation pattern of an antenna array in which a periodic structure 302 is sleeved over. The antenna array in which the periodic structure 302 is sleeved over has a better radiation direction than the antenna array in which the periodic structure is not sleeved over. In addition, distortion of a pattern of the high frequency dipole is reduced from 9 dB to less than 5 decibels (dB). Therefore, the radiation performance of the high frequency dipole and the low frequency dipole of the antenna array in which the periodic structure 302 is sleeved over the dipole 301 is better.

Therefore, in this embodiment of this application, the periodic structure 302 is sleeved over the dipole, so that the periodic structure 302 may change the equivalent dielectric constant or the equivalent permeability of the dipole, and the electromagnetic wave radiated to the dipole is diffracted. In this way, the electromagnetic wave may pass through the dipole in a diffraction manner, impact of the dipole on the electromagnetic wave radiated to the dipole is reduced, and impact on a radiation direction of another dipole is reduced, thereby improving wave transmission performance of the dipole. In addition, sleeving the periodic structure 302 over the dipole is equivalent to increasing the equivalent electrical size of the dipole, so that the operating bandwidth of the dipole may be increased.

Figure 16:
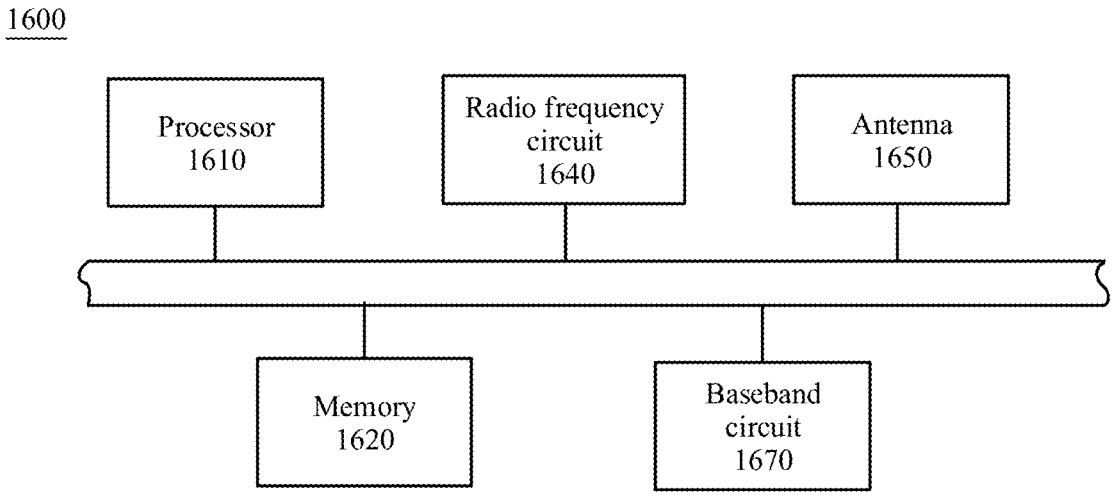
FIG. 16 is a schematic diagram of a structure of a network device according to an embodiment of this application.

The radiating element or the antenna array provided in the embodiments of this application may be further applied to various network devices that have a wireless communication function, for example, a terminal or a base station. For example, a structure of a network device may be shown in FIG. 16.

A network device 1600 includes a processor 1610, a memory 1620, a baseband circuit 1670, a radio frequency circuit 1640, and an antenna 1650. The processor 1610, the memory 1620, the baseband circuit 1670, the radio frequency circuit 1640, and the antenna 1650 are connected via a bus or another connection apparatus. The memory 1620 stores corresponding operation instructions. The processor 1610 executes the operation instructions to control the radio frequency circuit 1640, the baseband circuit 1670, and the antenna 1650 to work, to perform corresponding operations. For example, the processor 1610 may control the radio frequency circuit to generate a synthesized signal, and then radiate a first signal in a first frequency band and a second signal in a second frequency band by using the antenna. The antenna may include the antenna array or the radiating element provided in this application.

The foregoing embodiments are merely intended to describe the technical solutions of this application, but not to limit this application. Although this application is described in detail with reference to the foregoing embodiments, persons of ordinary skill in the art should understand that they may still make modifications to the technical solutions described in the foregoing embodiments or make equivalent replacements to some technical features thereof, without departing from the scope of the technical solutions of the embodiments of this application.

What is claimed is:

1. A radiating element, comprising:

a supporter; and one or more dipoles and suspended on a top of the supporter, and each dipole of the one or more dipoles is connected to the supporter at a specific angle; and a dipole arm of each dipole is covered with a periodic structure that comprises a plurality of metal rings, and the plurality of metal rings are sleeved over the dipole arm of each dipole; or the periodic structure comprises a plurality of planes, each of the plurality of planes comprises a ring structure, and the periodic structure is sleeved over the dipole arm of each dipole.

2. The radiating element according to claim 1, wherein the periodic structure comprises a metal conductor.

3. The radiating element according to claim 2, wherein the periodic structure is configured to enable an electromagnetic wave radiated to a first surface of each dipole to be incident to a second surface of each dipole, and the first surface and the second surface are any two opposite surfaces of each dipole.

4. The radiating element according to claim 3, wherein the periodic structure comprises a circular metal ring or a square metal ring.

5. The radiating element according to claim 1, wherein the plurality of dipoles comprise a first dipole and a second dipole, wherein:

the first dipole and the second dipole are perpendicularly arranged in a cross manner, and a radiation direction of the first dipole is different from a radiation direction of the second dipole.

6. The radiating element according to claim 5, wherein:

a groove is disposed on the first dipole, and the second dipole is inter-connected to the first dipole via the groove.

7. The radiating element according to claim 1, wherein:

a bottom of the supporter is fixedly connected to a reflector, each dipole is parallel to the reflector, and the reflector is configured to reflect the electromagnetic wave.

* * * * *